US006355407B1

(12) United States Patent
Takamuki et al.

(10) Patent No.: US 6,355,407 B1
(45) Date of Patent: Mar. 12, 2002

(54) THERMALLY DEVELOPABLE PHOTOSENSITIVE MATERIAL

(75) Inventors: Yasuhiko Takamuki; Hidetoshi Ezure; Tetsuo Shima; Hideki Komatsu; Kazuyoshi Goan, all of Hino (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 09/505,131

(22) Filed: Feb. 16, 2000

(30) Foreign Application Priority Data

Feb. 17, 1999 (JP) ..... 11-038591
Feb. 23, 1999 (JP) ..... 11-044784

(51) Int. Cl.[7] ..... G03C 1/498

(52) U.S. Cl. ..... 430/619; 430/531; 430/617; 430/620

(58) Field of Search ..... 430/619, 617, 430/620, 531

(56) References Cited

U.S. PATENT DOCUMENTS 5,705,328 A * 1/1998 Shiozaki ..... 430/531
6,090,538 A * 7/2000 Arai et al. ..... 430/619

FOREIGN PATENT DOCUMENTS

EP 0952481 * 10/1999

* cited by examiner

*Primary Examiner*—Thorl Chea
(74) *Attorney, Agent, or Firm*—Frishauf, Holtz, Goodman, Langer & Chick, P.C.

(57) ABSTRACT

A thermally developable photosensitive material comprising organic silver salts, photosensitive silver halides, and reducing agents. The thermally developable photosensitive material has a support having am moisture content of not more than 0.5 percent by weight.

20 Claims, 2 Drawing Sheets

THERMALLY DEVELOPABLE PHOTOSENSITIVE MATERIAL

FIELD OF THE INVENTION

The present invention relates to a thermally developable material which forms images employing thermal development, and a thermally developable material which exhibits high sensitivity as well as minimal fog, and improved pre-exposure storage stability, as well as a method for producing the same.

The present invention relates to a thermally developable photosensitive material, and particularly to a thermally developable photosensitive material which results in no layer peeling during thermal development and exhibits excellent heat resistant dimensional stability.

BACKGROUND OF THE INVENTION

Heretofore, a number of investigations have been performed on thermal development processes in which the development process is thermally carried out, and those which provide black-and-white images as well as color images, have been known. Further, a so-called thermal transfer type thermally developable material (hereinafter occasionally referred to as photosensitive material), in which an image obtained by thermal development is transferred from a photosensitive material to an image receptive layer, is also well known. A photosensitive material employing such a thermal development system is prepared by directly coating a prepared composition, as descried below, onto a film support. Said composition is prepared by adding a solution prepared by dissolving a reducing agent and a binder comprised of a thermoplastic resin in an organic solvent to an organic solvent dispersion comprising organic silver salts and silver halides. However, when the thermally developable photosensitive material, which is prepared as described above, is actually developed at a temperature of 80 to 150° C., practical problems have occurred in which the layer peels off due to thermal contraction of the support and the binder, and the decrease in the elastic modulus.

In order to minimize the layer peeling of a thermally developable photosensitive material during thermal development, it is generally known that a film support and a binder, which are commonly comprised of a thermoplastic resin having a glass transition point higher than the thermal development temperature, is employed. By employing a film support comprised of a thermoplastic resin and a thermoplastic binder having a glass transition point higher than the thermal development temperature, thermal contraction (deformation) as well as a decrease of elastic modulus due to heat is minimized to prevent the undesired layer peeling. However, it was found that even though the thermoplastic resin, having a glass transition point higher than the thermal development temperature, is employed, said layer peeling occurred.

Conventionally, in many thermally developable materials, the image forming layer, and the like, have been formed by applying a coating composition, in which organic solvents such as methyl ethyl ketone, methanol, and the like are employed. These solvents are highly soluble in water. As a result, during the production of a coating composition, water due to moisture condensation is inevitably introduced into the coating composition. Furthermore, organic silver salts comprise moisture depending on drying. In addition, it is difficult to sufficiently dry a thermally developable material at a high temperature after coating. Currently, in the thermally developable material after drying, there remains not only moisture but also organic solvents. Then, the following facts were discovered. Silver ions are dissociated from organic silver salts, such as silver behenate and the like, in the presence of moisture which is diffused to an image forming layer from the support and remains in the coating composition. Therefore, the resulting ions promote reactions of the organic silver salts with the reducing agents incorporated into the thermally developable material, and the formation of such silver ions is one of the big causes which result in fogging during production, as well as during pre-exposure storage.

SUMMARY OF THE INVENTION

In view of the foregoing, an object of the present invention is to provide a thermally developable photosensitive material which results in no layer peeling during thermal development, exhibits excellent heat resistant dimensional stability, and minimizes variation in dimensions due to heat. Another object of the present invention is provide a thermally developable material which exhibits high sensitivity as well as minimal fog, and excellent pre-exposure storage stability.

The present inventors have diligently investigated means to solve the problems described above, and have discovered that moisture as well as remaining solvents in a film support and a binder work as a plasticizer during thermal development, and results in thermal contraction (deformation) of the film support as well as of the binder, and also results in a decrease in the elastic modulus due to heat which in turn causes layer peeling. Thus it has been discovered that by controlling the moisture content ratio and/or the remaining solvent content ratio in a thermally developable photosensitive material, and the moisture content ratio of the film support, as well as a coating composition in a thermally developable photosensitive material which is prepared by coating a coating composition comprising organic solvents onto a film support, so that a thermally developable photosensitive material is obtained which results in no layer peeling during thermal development, exhibits excellent heat resistant dimensional stability, and minimizes variation in dimensions due to heat. Thus the present invention is accomplished. Further, the amount of the aforementioned moisture and remaining solvents correlates to fog formation during pre-exposure storage. By controlling said amount, it is possible to control the fog formation during pre-exposure storage. Thus, it was further discovered that it is possible to obtain a thermally developable photosensitive material which minimizes variation in dimensions due to heat.

Namely, the aforementioned objects of the present invention are achieved employing the embodiments described below.

The thermally developable photosensitive material of the invention comprises a layer containing organic silver salt, photosensitive silver halide and reducing agent provided on a support. Moisture content ratio of the support is not more than 0.5 percent by weight.

The moisture content ratio of the thermally developable photosensitive material after storage for 3 hours at 23° C. and 55% RH is preferably 0.5 percent by weight.

The moisture content ratio of the support is preferably 0.01 to 0.5 percent by weight.

The layer preferably contains a binder in an amount of 1.5 to 10 mg/m$^2$.

The layer is preferably composed of coating composition containing organic silver salt, photosensitive silver halide and reducing agent and having moisture content ratio of 2 weight % or less.

The average grain diameter of the organic silver salt is preferably 1 μm or less.

The aspect ratio of the organic silver salt is preferably at least 3.

The total amount of silver halide and organic silver salt is preferably 0.5 to 2.2 g per $m^2$ in terms of silver amount.

Preferable example of the reducing agent is a compound represented by formula

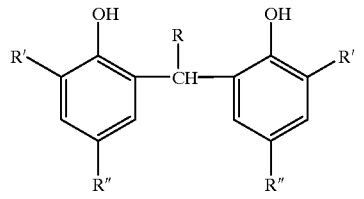

wherein R represents a hydrogen atom or an alkyl group having from 1 to 10 carbon, and R' and R" each represents an alkyl group having from 1 to 5 carbon.

The amount of the reducing agent is preferably $1\times10^{-2}$ to 10 moles per mole of silver.

The preferable example of the organic silver is silver behenate or silver arachidinate.

The coating composition is preferably coated on the support whose moisture content ratio is adjusted immediately before the coating not more than 0.5 percent by weight.

The amount of organic solvent is preferably 2.0 percent by weight or less.

The support is preferably subjected to discharge treatment.

DETAILED DESCRIPTION OF THE INVENTION

Figure 1:
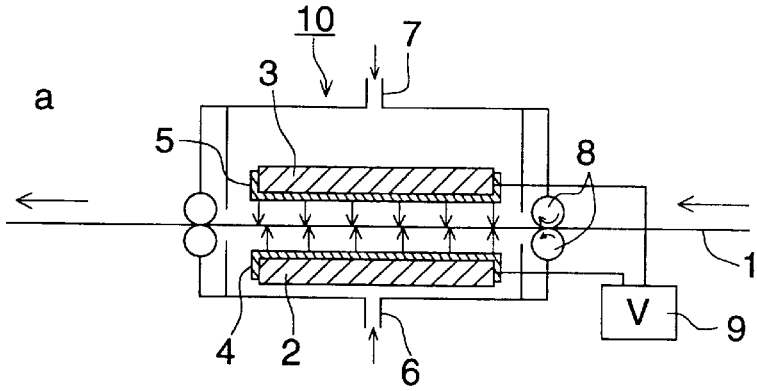
FIGS. 1(*a*)–1(*e*) are is a schematic construction views of surface treatment apparatuses of the first embodiment which carries out discharge treatment.
Figure 1:
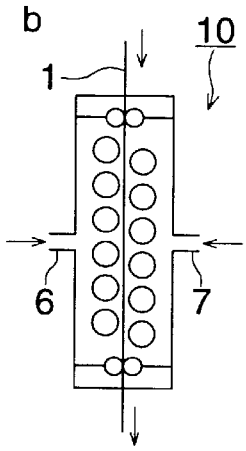
Figure 1:
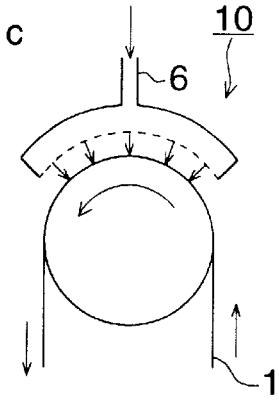
Figure 1:
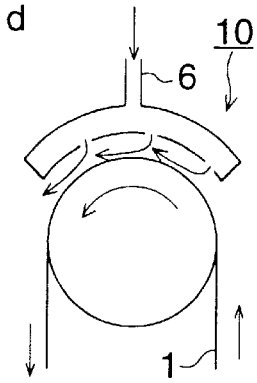
Figure 1:
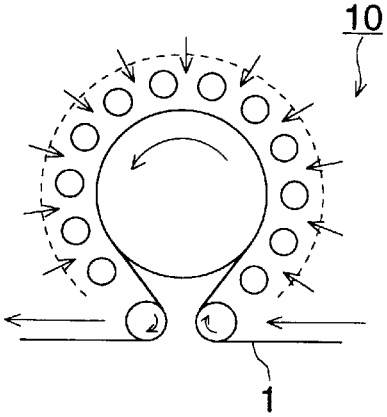

The present invention will now be detailed below.

In order to minimize bleeding of moisture to the image forming layer from the support, it is necessary to adjust the moisture content ratio of the support, of the present invention, to not more than 0.5 percent by weight. However, said moisture content ratio is preferably between 0.01 to 0.5 percent by weight, and is more preferably not more than 0.3 percent by weight.

Furthermore, in order to enhance the effects of the present invention, the moisture content ratio of the image forming layer, comprising at least organic silver salts, photosensitive silver halides, and reducing agents, is preferably not more than 2.0 percent by weight, is more preferably between 0.01 and 2.0 percent by weight, and is most preferably not more than 1.0 percent by weight.

In view of the stability during production as well as the enhancement of the effects of the present invention, the moisture content ratio of the coating composition, which constitutes an image forming layer, is preferably not more than 2.0 percent by weight, is more preferably between 0.01 and 2.0 percent by weight, and is most preferably not more than 1.0 percent by weight.

In order to enhance storage stability over an extended period of time, the moisture content ratio of the thermally developable photosensitive material of the present invention, when stored at 23° C. and 55% RH for 3 hours, is preferably not more than 0.5 percent by weight, is more preferably between 0.01 and 0.5 percent by weight, and is most preferably not more than 0.3 percent by weight. Further, specifically in order to improve the dimensional stability as well as to minimize layer peeling, the residual ratio of organic solvents in a thermally developable photosensitive material is preferably not more than 2.0 percent by weight, is more preferably between 0.01 and 2.0 percent by weight, and is most preferably not more than 1.0 percent by weight.

The moisture content ratio of a support may be adjusted employing any method. However, it is preferred to adjust said moisture content ratio before coating a coating composition constituting an image forming layer. Such methods include, for example; 1) a coating composition constituting an image forming layer is subjected to thermal treatment at 100° C. or higher, or 2) when a coating composition is placed in a coating process, the ambient relative humidity is controlled so that the moisture content ratio of a support is not more than 0.5 percent by weight, or the like. In 1), after the thermal treatment, it is more preferable to cover said coating composition with a water proof sheet.

The moisture content ratio of the support of the present invention can be measured employing a micromoisture meter (for instance, CA-02 Type manufactured by Mitsubishi Kagaku Co., Ltd.), in which the Karl Fischer method (coulometric titration method) is utilized. For example, the moisture content ratio can be measured as follows.

After humidifying a thermally developable photosensitive material in an ambience of 23° C. and 20% RH for 3 hours, the photosensitive layer, the protective layer and the backing layer of the thermally developable photosensitive material are peeled off employing methyl ethyl ketone (MEK). Thereafter, within 2 minutes, the weight W of the support is measured. Immediately after that, the moisture content w of the film support, is measured employing a micromoisture meter (for instance, CA-02 Type manufactured by Mitsubishi Kagaku Co., Ltd.) The measured moisture content w and weight W of the film support are substituted in the formula described below and the moisture content ratio D (in percent by weight) is obtained.

$$D \text{ (in percent by weight)} = (w/W)\times100$$

The moisture content ratio Dz of the thermally developable photosensitive material of the present invention is obtained employing a micromoisture meter (for instance, CA-02 Type manufactured by Mitsubishi Kagaku Co., Ltd.). After humidifying said thermally developable photosensitive material at 23° C. and 55% RH for 3 hours, its weight WZ is measured. Then, the moisture content wz of said material is measured employing a micromoisture meter (for instance, CA-02 Type manufactured by Mitsubishi Kagaku Co., Ltd.). The measured moisture content wz and weight WZ of said material are substituted for the formula described below, and the moisture content ratio D (in percent by weight) is obtained.

$$D \text{ (in percent by weight )} = (wz/WZ)\times100$$

The residual ratio of organic solvents in the thermally developable photosensitive material of the present invention is obtained as follows. After humidifying said thermally developable photosensitive material in an ambience of 23° C. and 55% RH for 3 hours, the weight WS of said material is measured. Immediately the moisture content ws is then measured by a micromoisture meter (for instance, CA-02 Type manufactured by Mitsubishi Kagaku Co., Ltd.). Thereafter, said material is heated at 150° C. for 5 minutes and the weight wsl of said material is then measured. Employing said measured values, the residual ratio Ds of solvents is obtained according to the formula described below.

$$DS \text{ (in percent by weight)} = (WS - ws - wsl)/WS$$

Any types of polymers may be employed for the support used for the thermally developable photosensitive material of the present invention, as long as the moisture content ratio during coating is not more than 0.5 percent. However, the polymers described below are preferably employed which exhibit excellent transparency as well as heat resistant dimensional stability, since they are employed as photographic supports.

They are polyethylene terephthalate (PET), polyethylene naphthalate (PEN), polycarbonate (PC), polyethersulfone (PES), polyarylate (Par), polyether ether ketone (PEEK), polysulfone (PSO), polyimde (PI), polyetherimide (PEI), polyamide (PAm), polystyrene (PS), syndioctatic polystyrene (SPS), and the like.

These polymers may be employed by forming a single layer or plural layers. Film may be prepared by employing homopolymers, copolymers in which a component composing said polymer is employed as a main component, or a polymer blend. The preferable example is prepared by substantially of PET, PEN and PC, more preferably PET and PEN. The main component as described herein means that the copolymer ratio or blend ratio of one of composing components is at least 50 percent by weight.

PET and PEN are comprised of terephthalic acid or naphthalenedicarboxylic acid with ethylene glycol, and can be prepared by polymerizing these in the presence of catalysts under suitable reaction conditions. At that time, a third component consisting of one type or two types may be mixed with said component. A suitable third component may be a compound having a divalent ester-forming functional group. Listed as examples of dicarboxylic acids may be dicarboxylic acids such as terephthalic acid, isophthalic acid, phthalic acid, 2,6-napthalenedicarboxylic acid, diphenylsulfonedicarboxylic acid, diphenyletherdicarboxylic acid, diphenylethanedicarboxylic acid, cyclohexanedicarboxylic acid, diphenyldicarboxylic acid, diphenylthioetherdicarboxylic acid, diphenylketonedicarboxylic acid, phenylindanedicarboxylic acid and the like. Further, listed as examples of glycols may be ethylene glycol, propylene glycol, tetramethylene glycol, cyclohexanedimethanol, 2,2-bis(4-hydroxyphenyl)propane, 2,2-(4-hydroxyethoxyphenyl)propane, bis(4-hydroxyphenyl) sulfone, bisphenol fluorenedihydroxyethyl ether, diethylene glycol, neopentyl glycol, hydroquinone, cyclohexanediol, and the like. In order to adjust the moisture content ratio of a support to not more than 0.5 percent by weight, those preferred are which leave neither a sulfonic acid group nor a hydroxyl group after polymerization.

The synthesis method of PET as well as PEN employed in the present invention is not limited, and PET as well as PEN may be produced employing any of the several conventional production methods known in the art. For instance, there are a direct esterification method in which a dicarboxylic component and a diol component undergo direct esterification, a transesterification method in which first dialkyl ester employed as a dicarboxylic acid component and a diol component undergo transesterification; thereafter, the reaction products are heated at a reduced pressure, and polymerized upon removing the excessive diol component, and the like. During the synthesis, if desired, it is possible to employ transesterification catalysts or polymerization catalysts, or to add heat resistant stabilizers. Further, during each synthesis process, may be added anti-coloring agents, antioxidants, crystal nucleus agents, slipping agents, stabilizers, anti-blocking agents, UV absorbers, viscosity adjusting agents, dyes, pigments, and the like.

In the present invention, if desired, it is also possible to provide a slipping property to the support. The method to provide the slipping property is not particularly limited. However, the following methods are generally employed: an external particle adding method in which fine inert inorganic particles are added, an internal particle depositing method in which catalysts added during polymer polymerization are deposited, a method in which a surface active agent and the like are coated onto the surface of film, and the like. Of these methods, the internal particle depositing method in which deposited particles can be controlled to a relatively small size is preferred, because said method can provide the slipping property without degrading the transparency of the film.

The thickness of the support employed in the present invention is not particularly restricted. The thickness may be adjusted so that the support exhibits the necessary strength for the specific use. Specifically, when employed for photosensitive photographic materials for medical and general printing use, the thickness is preferably between 50 and 250 $\mu$m, and is most preferably between 70 and 200 $\mu$m.

Further, the haze of the support employed in the present invention is preferably not more than 3 percent, and is more preferably not more than 1 percent. When a film having a haze of at least 3 percent is employed as a support for photosensitive photographic materials, resulting images are likely to be unsharp. Said haze is measured in accordance with ASTM-D1003-52.

The roll-set curl of the support employed in the present invention may be minimized employing the thermal treatment at a temperature below the Tg as described in U.S. Pat. No. 4,141,735, and a thermal treatment in which a support passes through an ambience maintained at Tg+25° C. to Tg+5° C. over 20 to 300 seconds while cooling as described in Japanese Patent Publication Open to Public Inspection Nos. 9-218486, 9-281650, and 10-103944.

Next, the coating method in the present invention will be described. The coating method in the present invention is not particularly limited, as long as it is possible that, after coating a coating composition comprising at least organic silver salts, photosensitive silver halides, and reducing agents onto a support, the resulting coating is subjected to drying and/or thermal treatment at 40 to 120° C. under a tension of 0.01 to 30 kg/cm$^2$.

The drying and/or thermal treatment is carried out preferably at 40 to 120° C., more preferably at 50 to 100° C., and most preferably at 60 to 80° C. An excessively high temperature is not preferable due to the likelihood of fogging. Furthermore, the tension is preferably kept low in the same manner as the adjustment method of the support. During conveyance and the like, the tension is preferably between 1.0 and 20 kg/cm$^2$, and is more preferably between 5 and 10 kg/cm$^2$.

Various types of coating methods are available such as dip coating, air knife coating, flow coating, or extrusion coating, employing the type of hopper described in U.S. Pat. No. 2,681,294. In addition, an extrusion coating method, a slide coating method, and a curtain coating method are acceptable which are described on pages 399 to 734 of Stephan F. Kister, M. Schwezer, "Liquid Film Coating" (published by Chapman & Hall Co., 1997). Further, if desired, at least two layers may be simultaneously coated employing methods described in U.S. Pat. Nos. 2,761,791, 3,508,947, 2,941,898, and 3,526,528, and on page 253 in Yuji Harazaki, "Coating Kogaku (Coating Engineering)" (published by Sakura Shoten, 1973).

In the present invention, there are mainly two types of methods to prepare a coating composition comprising a moisture content ratio of not more than 2.0 percent by weight. One type is a method in which an organic solvent having a water solubility of not more than 3 percent, and preferably not more than 2 percent by weight is employed in a coating composition. Listed as specific examples of such solvents are benzene, toluene, xylene, cyclohexane, diethyl ether, diisopropyl ether, hydrofluoroether, methylene chloride, chloroform, trichloroethylene, and the like. Further, organic solvents having a water solubility of not more than 3 percent by weight may be employed individually or in combination. Still further, in the range in which the moisture content ratio of a coating composition satisfies the conditions of not more than 2.0 percent by weight, water-compatible solvents described below may be employed together.

The other type is method is one in which a water-soluble solvent is used, and processes from the preparation of a coating composition to the coating of the resulting composition are carried out in inert gas such as nitrogen and the like, or one in which a coating composition prepared employing a water-soluble solvent is dehydrated in contact with desiccants. The water-soluble solvents as described herein means organic solvents having a water solubility of at least 3 percent by weight. Listed as specific examples may be acetone, methyl ethyl ketone, methyl isobutyl ketone, methanol, ethanol, isopropanol, butanol, tetrahydrofuran, dioxane, dioxolan, dimethylformamide, N-methylpyrrolidone, and the like. However, methyl ethyl ketone is preferred.

Further, the desiccants are not particularly limited, as long as they remove moisture upon contact, and silica gel, molecular sieves, magnesium sulfate anhydride, pure iron, iron compounds and the like are listed. Of these, silica gel is preferred.

Of the aforementioned methods, as method to surely remove water, the most preferred method is one in which water in a coating solution prepared employing a water-soluble solvent is brought into contact with desiccants to remove said water.

In the present invention, the moisture content of the coating composition comprising organic silver salts, photosensitive silver halide grains and reducing agents is generally between 5 and 50 g per mole of silver, is preferably between 5 and 40 g, and is more preferably between 5 and 20 g. The moisture content as described herein can be measured employing the Karl Fischer Method referring to "Moisture Measurement Method in Chemical Products" (JIS K 0068). In order to control the moisture content in the range as described above, a coating composition is generally placed under the circulation of nitrogen stream during at least 50 percent of its preparation time, more preferably during at least 80 percent, and more preferably during at least 90 percent.

Regarding moisture contained in a coating composition, the moisture content of organic silver salts is preferably not more than 5 percent by weight, is more preferably 3 percent by weight, and is still more preferably not more than 2 percent by weight. When the ratio of moisture brought by organic silver salts is large, the ratio of silver ions in the organic silver salts increases tending to result in an increase in fogging as well as variations in sensitivity.

In order to maintain the ratio of residual solvents in a thermally developable photosensitive material at not more than 2.0 percent, there are two methods; in one method, the aforementioned coating composition is coated onto a support, and subsequently dried; thereafter, the coating is again dried at 40 to 80° C. for 1 to 20 minutes, while in the other method, organic solvents, having a boiling point of not more than 85° C., are employed. Organic solvents having a boiling point of not more than 85° C. include methyl ethyl ketone, benzene, hexane, cyclohexane, diethyl ether, chloroform, methanol, ethanol, isopropanol, butanol, dioxane, and the like.

In order to control the moisture content ratio of a thermally developable material, there is a method in which a support and a coating composition of which moisture content ratio is controlled, and in addition, there are other methods in which a thermally developable material is heated and dried at 40 to 80° C. for 1 to 20 minutes, and the like.

Initially, a first embodiment will be described with reference to FIG. 1, which shows a schematic construction view of surface treatment apparatus 10 which carries out discharge treatment.

In FIG. 1*a,* support 1, which is continually conveyed between paired electrodes 2 and 3 employing a conveying means (not shown), is preferably a polymer support, and is more preferably various types of polyester supports such as PET, PEN, and the like which are commonly employed to produce photosensitive materials.

The gap between said paired electrodes 2 and 3, between which said support 1 is conveyed, is arranged in the ambience of inert gas (preferably argon gas, hereinafter, described as employing argon gas) at an atmospheric pressure or a pressure near the atmospheric pressure in which at least 50 percent of the pressure is due to the inert gas. Further, besides argon, the ambient gas may contain gases such as oxygen, nitrogen, carbon dioxide, helium, ketone or hydrocarbon, or steam. Specifically, when gas containing oxygen, nitrogen, carbon dioxide, ketone or hydrocarbon, or steam is contained, it is possible to carry out chemical modification and to further enhance the layer adhesion. Said gas is supplied into the gap between a pair of electrodes 2 and 3 employing a supply means (not shown) to maintain said ambience.

The paired electrodes 2 and 3 include a planar electrode (as shown in FIG. 1*a*), a cylindrical electrode (as shown in FIG. 1*b*) in which a plurality of cylindrical electrodes are arranged, or a roll electrode (as shown in FIGS. 1*c,* 1*d,* and 1*e*) in which one side of the electrode is brought into contact with a support, and are comprised of an electrically conductive member composed of metal such as stainless steel, aluminum, copper, and the like, and a dielectric (for example, ceramic and the like). Dielectrics 4 and 5 are arranged on the surface facing at least one paired electrodes 2 and 3. A plurality of said electrodes may be arranged in parallel. Further, the thickness of the dielectrics is preferably about 0.53 mm. However, the optimal thickness varies depending on conditions such as the material, the distance between electrodes, the support, the mixed gases, the power source, and the like. A pair of said electrodes are arranged so as to form a gap having a distance of not more than 10 mm. Further, supply outlets 6 and 7 are arranged so that gas is introduced into the gap between said electrodes. Generally, a plurality of supply outlets are arranged so that gas is uniformly introduced. They are usually installed in the interior of the electrode, but may also be installed in other positions. Further, said paired electrodes 2 and 3 are connected to power source 9 having a frequency in the range of 1 to 100 kHz, and preferably in the range of 1 to 10 kHz. Thus discharge is generated between a pair of said electrodes 2 and 3.

In such an embodiment, it is possible to enhance layer adhesion properties in such a manner that the surface (both surfaces in the present embodiment) of the support 1, which is continually conveyed, is subjected to discharge generated between said paired electrodes 2 and 3 in an ambience of a gas comprising argon having at least a partial pressure of 50 percent at one atmospheric pressure or at a similar pressure. In addition, the gas comprised of argon having at least a partial pressure of 50 percent, which is less expensive than helium, is employed. As a result, it is possible to decrease running cost. Further, argon exhibits excellent edging effect due to a larger molecular weight than helium, which results in uneven surface of the support 1 by hitting said surface. Thus, the layer adhesion properties are further enhanced. Still further, in the present embodiment, it is possible to generate stable discharge by adjusting the gap between said paired electrodes 2 and 3 within not more than 10 mm.

Furthermore, in the present embodiment, in the inlet side in which the support 1 enters the gap between said paired electrodes 2 and 3, at least one spare room is provided, and at least one pair of nip rollers 8 are provided to partition said room. At least one pair of said nip rollers work as a preventing means to prevent airflow accompanying the support 1 from entering the gap between the paired electrodes 2 and 3. Owing to this arrangement, the accompanying airflow does not enter the gap between the paired electrodes 2 and 3, and variation in gas concentration is minimized to make it possible to carry out more stable discharge. Further, as said preventing means, an air blade employing the same gas as that employed in the ambient area of the electrodes 2 and 3 may be employed instead of a pair of the nip rollers, as in the present embodiment.

Further, in the present embodiment, by making the conveying direction of the support 1 perpendicular, each flatness of paired electrodes, which are planar electrodes, is not adversely affected. As a result, it is advantageous to maintain the gap between paired electrodes.

Figure 2:
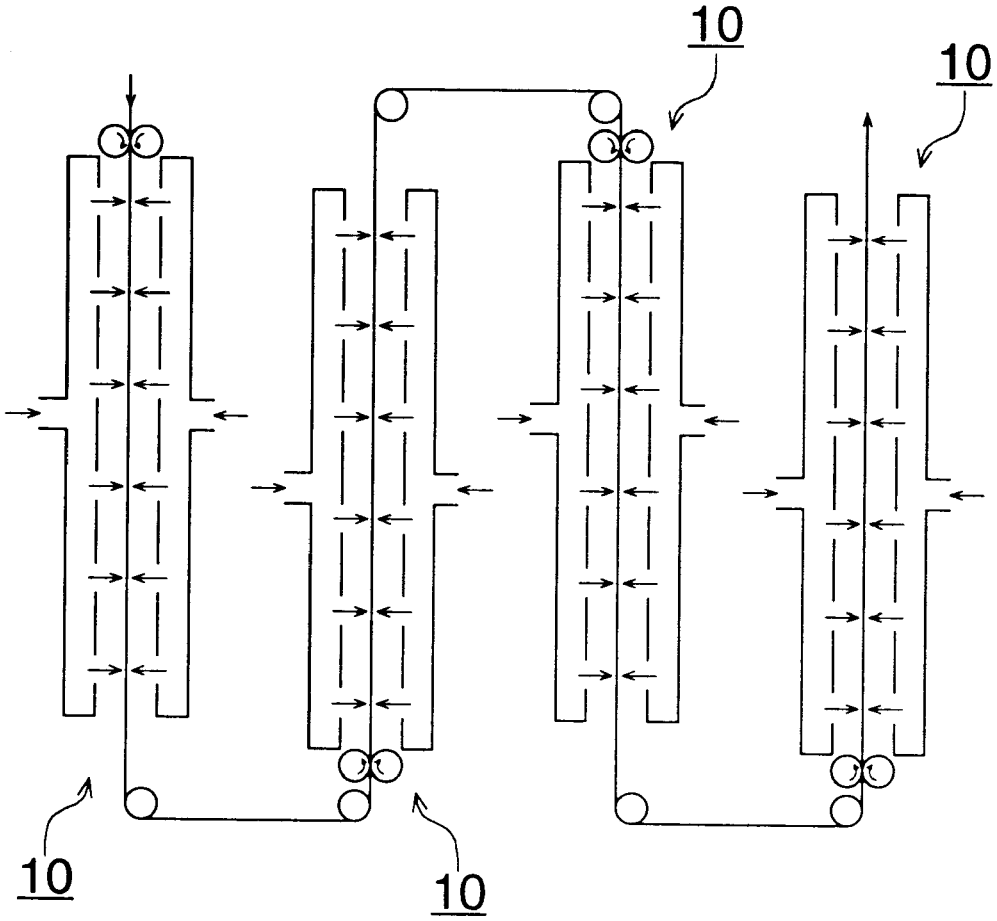
FIG. 2 is a schematic construction view of a surface treatment apparatus of a modified example of the first embodiment.

Still further, in the present embodiment, an embodiment, in which one surface treatment apparatus 10 is provided, is described. However, as shown in FIG. 2, a plurality of said surface treatment apparatuses may be provided. Further, since the apparatus shown in FIG. 2 is the same as the present embodiment, description is abbreviated. Further, instead of arranging them as shown in FIG. 2, they may also be parallelly arranged in the conveying direction.

Thermally developable photosensitive materials, which form photographic images employing a thermally developable processing method, are disclosed, for example, in U.S. Pat. Nos. 3,152,904 and 3,457,075, and D. Morgan and B. Shely, Thermally Processed Silver Systems (Imaging Processes and Materials, Neblette 8th edition, edited by Sturge, V. Walworth, A. Shepp, page 2, 1969). In the present invention the image is formed by developing the photosensitive material thermally at 80–140° C., and no fix processing is applied. Therefore silver halide or organic silver in unexposed area are not removed and remain in the photosensitive material.

Optical transmittance density at 400 nm of the photosensitive material including the support after development is preferably not more than 0.2, more preferably not more than 0.02.

Silver halide grains of photosensitive silver halide in the present invention work as a light sensor. In order to minimize translucence after image formation and to obtain excellent image quality, the less the average grain size, the more preferred, and the average grain size is preferably less than 0.1 μm; is more preferably between 0.01 and 0.1 μm, and is most preferably between 0.02 and 0.08 μm. The average grain size as described herein denotes an average edge length of silver halide grains, when they are so-called regular crystals of cube or octahedron. Furthermore, when grains are not regular crystals, for example, spherical, cylindrical, and tabular grains, the grain size refers to the diameter of a sphere having the same volume as the silver grain.

Furthermore, silver halide grains are preferably monodisperse grains. The monodisperse grains as described herein refer to grains having a monodispersibility obtained by the formula described below of less than 40 percent; more preferably less than 30 percent, and most preferably between 0.1 and 20 percent.

Monodispersibility=(standard deviation of grain diameter)/(average of grain diameter)×100

In the present invention, it is preferred that the silver halide grains have an average grain size of 0.1 μm or less and is monodispersed, whereby the graininess of the image is improved.

The silver halide grain shape is preferred, in which a high ratio occupying a Miller index (100) plane is preferred. This ratio is preferably at least 50 percent; is more preferably at least 70 percent, and is most preferably at least 80 percent. The ratio occupying the Miller index (100) plane can be obtained based on T. Tani, J. Imaging Sci., 29, 165 (1985) in which adsorption dependency of a (111) plane and a (100) plane is utilized.

Furthermore, another preferred silver halide shape is a tabular grain. The tabular grain as described herein is a grain having an aspect ratio represented by r/h of at least 3, wherein r represents a grain diameter in μm obtained as the square root of the projection area, and h represents thickness in μm in the vertical direction.

Of these, the aspect ratio is preferably between 3 and 50. The grain diameter is preferably not more than 0.1 μm, and is more preferably between 0.01 and 0.08 μm. These are described in U.S. Pat. Nos. 5,264,337, 5,314,789, 5,320,958, and others. In the present invention, when these tabular grains are used, image sharpness is further improved.

The composition of silver halide may be any of silver chloride, silver chlorobromide, silver chloroiodobromide, silver bromide, silver iodobromide, or silver iodide. The photographic emulsion employed in the present invention can be prepared employing methods described in P. Glafkides, "Chimie et Physique Photographique" (published by Paul Montel Co., 1967), G. F. Duffin, ìphotographic Emulsion Chemistryî (published by The Focal Press, 1966), V. L. Zelikman et al., ìMaking and Coating Photographic Emulsionî (published by The Focal Press, 1964), etc. Namely, any of several acid emulsions, neutral emulsions, ammonia emulsions, and the like may be employed. Furthermore, when grains are prepared by allowing soluble silver salts to react with soluble halide salts, a single-jet method, a double-jet method, or combinations thereof may be employed. The resulting silver halide may be incorporated into an image forming layer utilizing any practical method, and at such time, silver halide is placed adjacent to a reducible silver source. Silver halide may be prepared by converting a part or all of the silver in an organic silver salt formed through the reaction of an organic silver salt with halogen ions into silver halide. Silver halide may be previously prepared and the resulting silver halide may be added to a solution to prepare the organic silver salt, or combinations thereof may be used, however the latter is preferred. Generally, the content of silver halide in organic silver salt is preferably between 0.75 and 30 weight percent.

Silver halide is preferably comprised of ions of metals or complexes thereof, in transition metal belonging to Groups 6 to 11 of the Periodic Table. As the above-mentioned metals, preferred are W, Fe, Co, Ni, Cu, Ru, Rh, Pd, Re, Os, Ir, Pt and Au.

These metals may be incorporated into silver halide in the form of complexes. In the present invention, regarding the transition metal complexes, six-coordinate complexes represented by the formula described below are preferred.

$(ML_6)^m$:

wherein M represents a transition metal selected from elements in Groups VIB, VIIB, VIII, and IB of the Periodic Table; L represents a coordinating ligand; and m represents 0, −1, −2, or −3.

Specific examples represented by L include halogens (fluorine, chlorine, bromine, and iodine), cyan, cyanato, thiocyanato, selenocyanato, tellurocyanato, each ligand of azido and aquo, nitrosyl, thionitrosyl, etc., of which aquo, nitrosyl and thionitrosyl are preferred. When the aquo ligand is present, one or two ligands are preferably coordinated. L may be the same or different.

The particularly preferred specific example of M is rhodium (Rh), ruthenium (Ru), rhenium (Re) or osmium (Os).

Specific examples of transition metal ligand complexes are described below.

1: $[RhCl_6]^{3-}$
2: $[RuCl_6]^{3-}$
3: $[ReCl_6]^{3-}$
4: $[RuBr_6]^{3-}$
5: $[OsCl_6]^{3-}$
6: $[IrCl_6]^{4-}$
7: $[Ru(NO)Cl_5]^{2-}$
8: $[RuBr_4(H_2O)]^{2-}$
9: $[Ru(NO)(H_2O)Cl_4]^{-}$
10: $[RhCl_5(H_2O)]^{2-}$
11: $[(Re(NO)Cl_5]^{2-}$
12: $[Re(NO)CN_5]^{2-}$
13: $[Re(NO)ClCN_4]^{2-}$
14: $[Rh(NO)_2Cl_4]^{-}$
15: $[Rh(NO)(H_2O)Cl_4]^{-}$
16: $[Ru(NO)CN_5]^{2-}$
17: $[Fe(CN)_6]^{3-}$
18: $[Rh(NS)Cl_5]^{2-}$
19: $[Os(NO)Cl_5]^{2-}$
20: $[Cr(NO)Cl_5]^{2-}$
21: $[Re(NO)Cl_5]^{-}$
22: $[Os(NS)Cl_4(TeCN)]^{2-}$
23: $[Ru(NS)Cl_5]^{2-}$
24: $[Re(NS)Cl_4(SeCN)]^{2-}$
25: $[Os(NS)Cl(SCN)_4]^{2-}$
26: $[Ir(NO)Cl_5]^{2-}$
27: $[Ir(Ns)Cl_5]^{2-}$

One type of these metal ions or complex ions may be employed and the same type of metals or the different type of metals may be employed in combinations of two or more types.

Generally, the content of these metal ions or complex ions is suitably between $1\times10^{-9}$ and $1\times10^{-2}$ mole per mole of silver halide, and is preferably between $1\times10^{-8}$ and $1\times10^{-4}$ mole.

Compounds, which provide these metal ions or complex ions, are preferably incorporated into silver halide grains through addition during the silver halide grain formation. These may be added during any preparation stage of the silver halide grains, that is, before or after nuclei formation, growth, physical ripening, and chemical ripening. However, these are preferably added at the stage of nuclei formation, growth, and physical ripening; furthermore, are preferably added at the stage of nuclei formation and growth; and are most preferably added at the stage of nuclei formation.

These compounds may be added several times by dividing the added amount. Uniform content in the interior of a silver halide grain can be carried out. As described in Japanese Patent Publication Open to Public Inspection No. 63-29603, 2-306236, 3-167545, 4-76534, 6-110146, 5-273683, etc., incorporation can be carried out so as to result preferably in distribution formation in the interior of a grain.

These metal compounds can be dissolved in water or a suitable organic solvent (for example, alcohols, ethers, glycols, ketones, esters, amides, etc.) and then added. Furthermore, there are methods in which, for example, an aqueous metal compound powder solution or an aqueous solution in which a metal compound is dissolved along with NaCl and KCl is added to a water-soluble silver salt solution during grain formation or to a water-soluble halide solution; when a silver salt solution and a halide solution are simultaneously added, a metal compound is added as a third solution to form silver halide grains, while simultaneously mixing three solutions; during grain formation, an aqueous solution comprising the necessary amount of a metal compound is placed in a reaction vessel; or during silver halide preparation, dissolution is carried out by the addition of other silver halide grains previously doped with metal ions or complex ions. Specifically, the preferred method is one in which an aqueous metal compound powder solution or an aqueous solution in which a metal compound is dissolved along with NaCl and KCl is added to a water-soluble halide solution.

When the addition is carried out onto grain surfaces, an aqueous solution comprising the necessary amount of a metal compound can be placed in a reaction vessel immediately after grain formation, or during physical ripening or at the completion thereof or during chemical ripening.

The light sensitive silver halide emulsion is desalted by washing such as noodle method, flocculation method etc. Desalt processing is not required in the invention.

The light sensitive silver halide grains are preferably chemically ripened. The preferable chemical ripening method includes sulfur sensitization, selenium sensitization and tellurium sensitization. Further noble metal sensitization employing gold, platinum, palladium or iridium compound, or reduction sensitization may be applied. Examples of compounds employed in sulfur sensitization, selenium sensitization and tellurium sensitization includes those described in Japanese Patent Publication Open to Public Inspection No. 7-128768. Examples of tellurium compound includes diacyltellurides, bis(oxycarbonyl)tellurides, bis(carbamoyl)tellurides, diacyltellurdes, bis(oxycarbonyl)ditellurides, bis(carbamoyl)ditellurides, compounds containing P=Te bonding, salts of tellurocarbonic acid, Te-organyltellurocarbonic acid esters, telluride, tellurols, telluroacetals, tellurosulfonates, compounds containing P-Te bonding, heterocyclic compounds containing Te, tellurocarbonyl compounds, inorganic tellurium compounds and colloidal tellurium.

Examples of compounds employed in noble metal sensitization includes, auric acid, potassium chloroaurate, potassium aurithiocyanate, gold sulfide, gold selenide, and compounds described in U. S. Pat. No. 2,448,061, British Patent No. 618,061. Concrete examples employed in reduction sensitization includes, in addition to ascorbic acid and thioureadioxide, stannous chloride, aminoisomethanesulfinic acid, hydrazine derivatives, borane compounds, silane compounds and polyamine compounds. Reduction sensitization can be conducted by ripening the emulsion being kept at pH of not less than 7 or at pAg of not more than 8.3. Reduction sensitization can also be conducted by introducing single addition part during the forming silver halide grains.

Organic silver salts employed in the present invention are reducible silver sources and preferred are organic acids and silver salts of hetero-organic acids having a reducible silver ion source, specifically, long chain (having from 10 to 30 carbon atoms, but preferably from 15 to 25 carbon atoms) aliphatic carboxylic acids and nitrogen-containing heterocyclic rings. Organic or inorganic silver salt complexes are also useful in which the ligand has a total stability constant for silver ion of 4.0 to 10.0. Examples of preferred silver salts are described in Research Disclosure, Items 17029 and 29963, and include the following; organic acid salts (for example, salts of gallic acid, oxalic acid, behenic acid, arachidinic acid stearic acid, palmitic acid, lauric acid, etc.); carboxyalkylthiourea salts (for example, 1-(3-carboxypropyl)thiourea, 1-(3-carboxypropyl)-3,3-dimethylthiourea, etc.); silver complexes of polymer reaction products of aldehyde with hydroxy-substituted aromatic carboxylic acid (for example, aldehydes (formaldehyde, acetaldehyde, butylaldehyde, etc.), hydroxy-substituted acids (for example, salicylic acid, benzoic acid, 3,5-dihydroxybenzoic acid, 5,5-thiodisalicylic acid, silver salts or complexes of thioenes (for example, 3-(2-carboxyethyl)-4-hydroxymethyl-4-(thiazoline-2-thioene and 3-carboxymethyl-4-thiazoline-2-thioene), complexes of silver with nitrogen acid selected from imidazole, pyrazole, urazole, 1,2,4-thiazole, and 1H-tetrazole, 3-amino-5-benzylthio-1,2,4-triazole and benztriazole or salts thereof; silver salts of saccharin, 5-chlorosalicylaldoxime, etc.; and silver salts of mercaptides The preferred silver salt is silver behenate.

Organic silver salts can be prepared by mixing a water-soluble silver compound with a compound which forms a complex with silver, and employed preferably are a normal precipitation, a reverse precipitation, a double-jet precipitation, a controlled double-jet precipitation as described in Japanese Patent Publication Open to Public Inspection No. 9-127643, etc. For example, after forming organic acid alkalimetal soap (for example, sodium behenate sodium arginate) by adding alkalimetal salt such as sodiumhydroide, potassium oxide, to organic acid, above mentioned soap and silver nitrate etc. are added to form crystals of organic silver salt. In this instance silver halide grain may be mixed.

In the present invention, organic silver salts have an average grain diameter of 1 $\mu$m or less and are monodispersed. The average diameter of the organic silver salt as described herein is, when the grain of the organic salt is, for example, a spherical, cylindrical, or tabular grain, a diameter of the sphere having the same volume as each of these grains. The average grain diameter is preferably between 0.01 and 0.8 $\mu$m, and is most preferably between 0.05 and 0.5 $\mu$m. Furthermore, the monodisperse as described herein is the same as silver halide grains and preferred monodispersibility is between 1 and 30 percent. In the present invention, the organic silver salts are preferably composed of monodispersed grains with an average diameter of not more than 1 $\mu$m. When grains are prepared within this range, high density images can be obtained.

Furthermore, another preferred silver halide shape is a tabular grain. The tabular grain as described herein is a grain having an aspect ratio represented by r/h of at least 3, wherein r represents a grain diameter in $\mu$m obtained as the square root of the projection area, and h represents thickness in $\mu$m in the vertical direction.

The organic silver crystals are pulverized and dispersed with binder and surfactant by employing ball mills.

In the present invention, in order to achieve the specified optical density, the total amount of silver halides and organic silver salts is preferably between 0.5 and 2.2 g per $m^2$ in terms of silver amount. When prepared within this range, high contrast images can be obtained. Amount of the silver halide to whole silver amount is preferably not more than 50 wt %, more preferably 25 wt %, specifically 0.1–15 wt %.

Reducing agents are preferably incorporated into the thermally developable photosensitive material of the present invention. Examples of suitable reducing agents are described in U.S. Pat. Nos. 3,770,448, 3,773,512, and 3,593,863, and Research Disclosure Items 17029 and 29963, and include the followings:

Aminohydroxycycloalkenone compounds (for example, 2-hydroxypiperidino-2-cyclohexane); esters of amino reductones as the precursor of reducing agents (for example, piperidinohexose reducton monoacetate); N-hydroxyurea derivatives (for example, N-p-methylphenyl-N-hydroxyurea); hydrazones of aldehydes or ketones (for example, anthracenealdehyde phenylhydrazone; phosphamidophenols; phosphamidoanilines; polyhydroxybenzenes (for example, hydroquinone, t-butylhydroquinone, isopropylhydroquinone, and (2,5-dihydroxy-phenyl) methylsulfone); sulfydroxamic acids (for example, benzenesulfhydroxamic acid); sulfonamidoanilines (for example, 4-(N-methanesulfonamide)aniline); 2-tetrazolylthiohydroquinones (for example, 2-methyl-5-(1-phenyl-5-tetrazolylthio)hydroquinone); tetrahydroquinoxalines (for example, 1,2,3,4-tetrahydroquinoxaline); amidoxines; azines (for example, combinations of aliphatic carboxylic acid arylhydrazides with ascorbic acid); combinations of polyhydroxybenzenes and hydroxylamines, reductones and/or hydrazine; hydroxamic acids; combinations of azines with sulfonamidophenols; α-cyanophenylacetic acid derivatives; combinations of bis-β-naphthol with 1,3-dihydroxybenzene derivatives; 5-pyrazolones, sulfonamidophenol reducing agents, 2-phenylindane-1,3-dione, etc.; chroman; 1,4-dihydropyridines (for example, 2,6-dimethoxy-3,5-dicarboethoxy-1,4-dihydropyridine); bisphenols (for example, bis(2-hydroxy-3-t-butyl-5-methylphenyl)methane, bis(6-hydroxy-m-tri)mesitol, 2,2-bis(4-hydroxy-3-methylphenyl)propane, 4,5-ethylidene- bis(2-t-butyl-6-methyl)phenol, UV-sensitive ascorbic acid derivatives and 3-pyrazolidones. Of these, particularly preferred reducing agents are hindered phenols.

As hindered phenols, listed are compounds represented by the general formula (A) described below.

General formula (A):

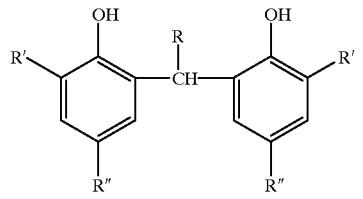

wherein R represents a hydrogen atom or an alkyl group having from 1 to 10 carbon atoms (for example, —$C_4H_9$, 2,4,4-trimethylpentyl), and R' and R" each represents an alkyl group having from 1 to 5 carbon atoms (for example, methyl, ethyl, t-butyl).

Specific examples of the compounds represented by the general formula (A) are described below.

A-1

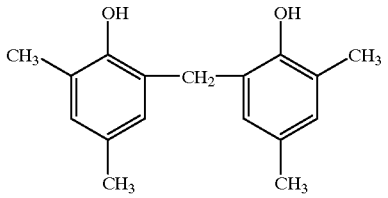

A-2

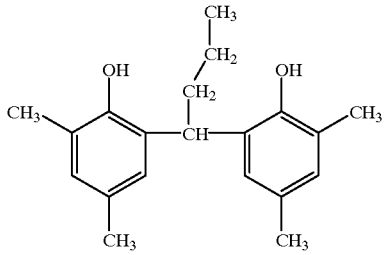

A-3

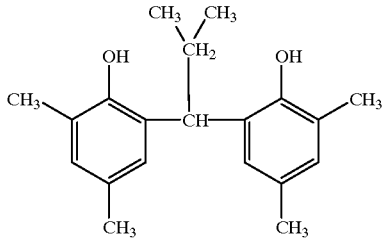

A-4

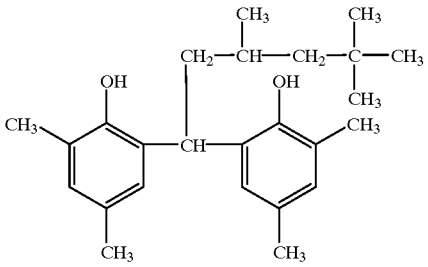

-continued

A-5

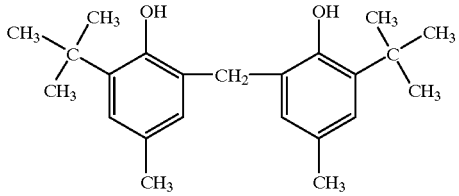

A-6

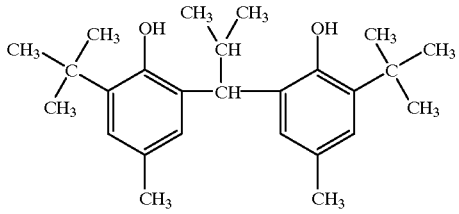

A-7

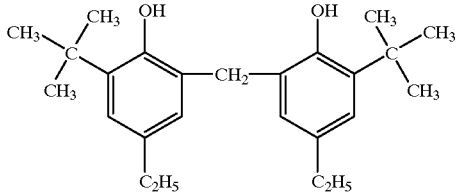

The used amount of reducing agents first represented by the above-mentioned general formula (A) is preferably between $1\times10^{-2}$ and 10 moles per mole of silver, and is most preferably between $1\times10^{-2}$ and 1.5 moles.

Binders suitable for the thermally developable photosensitive material to which the present invention is applied are transparent or translucent, and generally colorless. Binders are natural polymers, synthetic resins, and polymers and copolymers, other film forming media; for example, gelatin, gum arabic, poly(vinyl alcohol), hydroxyethyl cellulose, cellulose acetate, cellulose acetatebutylate, poly (vinylpyrrolidone), casein, starch, poly(acrylic acid), poly (methylmethacrylic acid), poly(vinyl chloride), poly (methacrylic acid), copoly(styrene-maleic acid anhydride), copoly(styrene-acrylonitrile, copoly(styrene-butadiene, poly (vinyl acetal) series (for example, poly(vinyl formal)and poly(vinyl butyral), poly(ester) series, poly(urethane) series, phenoxy resins, poly(vinylidene chloride), poly(epoxide) series, poly(carbonate) series, poly(vinyl acetate) series, cellulose esters, poly(amide) series. These may be hydrophilic or hydrophobic. A nonlight-sensitive layer may be provided at the outer side of the light sensitive layer for the purpose of protecting the surface of the photosensitive material or preventing scratches. Binders employed in the nonlight-sensitive layer may be the same or different species as that of light sensitive layer.

In the present invention, the amount of the binder in a image forming layer is preferably between 1.5 and 10 g/$m^2$, and is more preferably between 1.7 and 8 g/$m^2$ so as to obtain desirable density of image.

In the present invention, a matting agent is preferably incorporated into the image forming layer side. In order to minimize the image abrasion after thermal development, the matting agent is provided on the surface of a photosensitive material and the matting agent is preferably incorporated in an amount of 0.5 to 30 percent in weight ratio with respect to the total binder in the emulsion layer side.

Materials of the matting agents employed in the present invention may be either organic substances or inorganic substances. Regarding inorganic substances, for example, those can be employed as matting agents, which are silica described in Swiss Patent No. 330,158, etc.; glass powder described in French Patent No. 1,296,995, etc.; and carbonates of alkali earth metals or cadmium, zinc, etc. described in U.K. Patent No. 1.173,181, etc. Regarding organic substances, as organic matting agents those can be employed which are starch described in U.S. Pat. No. 2,322,037, etc.; starch derivatives described in Belgian Patent No. 625,451, U.K. Patent No. 981,198, etc.; polyvinyl alcohols described in Japanese Patent Publication No. 44-3643, etc.; polystyrenes or polymethacrylates described in Swiss Patent No. 330,158, etc.; polyacrylonitriles described in U.S. Pat. No. 3,079,257, etc.; and polycarbonates described in U.S. Pat. No. 3,022,169.

The shape of the matting agent may be crystalline or amorphous. However, a crystalline and spherical shape is preferably employed. The size of a matting agent is expressed in the diameter of a sphere which has the same volume as the matting agent.

The matting agents preferably employed in the invention are those having average particle size of 0.5 to 10 $\mu$m, more preferably 1.0 to 8.0 $\mu$m. The variation coefficient of size distribution of the matting agent is preferably 50% or less, more preferably 30% or less.

The variation coefficient of size distribution is defined as (standard deviation of grain size)/(average of grain size)×100 (in percent).

The matting agent may be contained in any layers. Preferable example is a layer other than a photosensitive layer, particularly farthest layer from a support.

The thermally developable photosensitive material forms a photographic image by thermal development, and contains, preferably, reduceable silver source (organic silver), light sensitive silver halide, reducing agent and toning agent control color if required dispersed in ordinarily (organic) binder matrix.

Thermally developable photosensitive materials are stable at normal temperature, and after exposure, when they are heated to high temperatures (for example, between 80 and 140° C.), they are developed. Upon heating them, silver is formed through an oxidation-reduction reaction of an organic silver salt (working as an oxidizing agent) with a reducing agent. This oxidation-reduction reaction is accelerated with a catalytic action of a latent image formed in photosensitive silver halide by exposure. Silver formed by the reaction of an organic silver salt in an exposed area provides a black image. This is in contrast to the unexposed area, and thereby forms an image. This reaction process proceeds without providing a processing solution such as water from the outside.

The thermally developable photosensitive material comprises a support having thereon at least one image forming layer, and the image forming layer may only be formed on the support. Further, at least one nonphotosensitive layer is preferably formed on the image forming layer. In order to control the amount or wavelength distribution of light transmitted through the image forming layer, a filter layer may be provided on the same side as the image forming layer, or on the opposite side. Dyes or pigments may also be incorporated into the image forming layer. The dye can be employed if it absorbs light having desired wavelength. Preferable examples include compounds described in, for example, Japanese Patent Publication Open to Public Inspection Nos. 59-6481, 59-182436, U.S. Pat. Nos. 4,271,267, 4,594,312, EP-A-533,008, EP-A-652,473, Japanese Patent Publication Open to Public Inspection Nos. 2-216140, 4-348339, 7-191432 and 7-301890.

In the nonlight-sensitive layer preferably contains above mentioned binder and matting agent, and may contain a lubricant such as polysiloxane compound, wax, fluid paraffin.

The light sensitive layer may be formed as plural layers, and in this case higher sensitivity layer is positioned at the inner layer or outer layer for the purpose of contrast control.

Image color control agents are preferably incorporated into the thermally developable photosensitive material of the present invention. Examples of suitable image color control agents are disclosed in Research Disclosure Item 17029, and include the following:

imides (for example, phthalimide), cyclic imides, pyrazoline-5-ons, and quinazolinon (for example, succinimide, 3-phenyl-2-pyrazoline-5-on, 1-phenylurazole, quinazoline and 2,4-thiazolidion); naphthalimides (for example, N-hydroxy-1,8-naphthalimide); cobalt complexes (for example, cobalt hexaminetrifluoroacetate), mercaptans (for example, 3-mercapto-1,2,4-triazole); N-(aminomethyl) aryldicarboxyimides (for example, N-(dimethylaminomethyl)phthalimide); blocked pyrazoles, isothiuronium derivatives and combinations of certain types of light-bleaching agents (for example, combination of N,N Í-hexamethylene(1-carbamoyl-3,5-dimethylpyrazole), 1,8-(3,6-dioxaoctane)bis-(isothiuroniumtrifluoroacetate), and 2-(tribromomethylsulfonyl)benzothiazole; merocyanine dyes (for example, 3-ethyl-5-((3-ethyl-2-benzothiazolinylidene(benzothiazolinylidene))-1-methylethylidene-2-thio-2,4-oxazolidinedione); phthalazinone, phthalazinone derivatives or metal salts thereof (for example, 4-(1-naphthyl)phthalazinone, 6-chlorophthalazinone, 5,7-dimethylphthalazinone, and 2,3-dihydro-1,4-phthalazinedione); combinations of phthalazinone and sulfinic acid derivatives (for example, 6-chlorophthalazinone+benzenesulfinic acid sodium or 8-methylphthalazinone+p-trisulfonic acid sodium); combinations of phthalazine+phthalic acid; combinations of phthalazine (including phthalazine addition products) with at least one compound selected from maleic acid anhydride, and phthalic acid, 2,3-naphthalenedicarboxylic acid or o-phenylenic acid derivatives and anhydrides thereof (for example, phthalic acid, 4-methylphthalic acid, 4-nitrophthalic acid, and tetrachlorophthalic acid anhydride); quinazolinediones, benzoxazine, naphtoxazine derivatives, benzoxazine-2,4-diones (for example, 1,3-benzoxazine-2,4-dione); pyrimidines and asymmetry-triazines (for example, 2,4-dihydroxypyrimidine), and tetraazapentalene derivatives (for example, 3,6-dimercapto-1,4-diphenyl-1H,4H-2,3a,5,6a-tatraazapentalene). Preferred image color control agents include phthalazone or phthalazine.

A mercapto compound, disulfide compound or thion compound may be incorporated in for controlling the development to accelerate or retard, improving efficiency of optical sensitization, improving preserve ability of the photosensitive material before or after development.

The mercapto compound is preferably that represented by Ar—SM, Ar—S—S—Ar, wherein M is a hydrogen or alkalimetal atom, Ar is an aromatic cycle or condensed aromatic cycle containing at least one of nitrogen, sulfur, selenium or tellurium. The preferable heterocycle examples includes benzimidazole, naphthimidazole, benzothizole, naphththiazole, benzooxazole, naphthooxazole, benzoselenazole, benzotetrazole, imidazole, oxazole, pyrrazole, triazole, tetrazole, triazine, pyrimidine, pyridazine, pyrazine, pyridine, purine, quinoline, or quinazoline. The heterocycle may have a substituent that is selected from a group consisting of halogen (Br or Cl), hydroxy, amino, carboxy, alkyl (for example, those having at least one carbon atom, preferably 1–4 carbon atoms), and alkoxy (for example, those having at least one carbon atom, preferably 1–4 carbon atoms). Examples of mercapto substituted heterocyclic compound include 2-mercaptobenzimidazole, 2-mercaptobenzoxazole, 2-mercaptobenzthiazole, 2-mercapto-5-methylbenzothiazole, 3-mercapto-1,2,4-triazole, 2-mercaptoquinoline, 8-mercaptopurine, 2,3,5,6-tetrachloro-4-pyridinediol, 4-hydroxy-2-mercaptopyrimidine, 2-mercapto-4-phenyloxazole.

Antifoggants may be incorporated into the thermally developable photosensitive. Mercury ion is conventionally known as the most effective anti-foggant. Employing mercury compound in a photosensitive layer is disclosed in U.S. Pat. Nos. Preferred are those antifoggants as disclosed in, for example, U.S. Pat. No. 3,589,903. However mercury compound is not desireble because of environmental problems. As for a mercury-free antifoggants, compounds disclosed in U.S. Pat. No. 4,546,075 and Japanese Patent Publication Open to Public Inspection No. 59-57234 are preferable.

Particularly preferred mercury-free antifoggants are heterocyclic compounds having at least one substituent, represented by —C(X1)(X2)(X3) (wherein X1 and X2 each represents halogen, and X3 represents hydrogen or halogen), as disclosed in U.S. Pat. Nos. 3,874,946 and 4,756,999. As examples of suitable antifoggants, employed preferably are compounds and the like described in paragraph numbers 0030 to 0036 of Japanese Patent Publication Open to Public Inspection No. 9-288328. The other examples of suitable antifoggants employed preferably are compounds described in paragraph numbers 0062 and 0063 of Japanese Patent Publication Open to Public Inspection No. 9-90550.

Furthermore, more suitable antifoggants are disclosed in U.S. Pat. No. 5,028,523, and U.K. Patent Application Nos. 9221383.4, 9300147.7, and 9311790.1.

In the thermally developable photosensitive material of the present invention, employed can be sensitizing dyes described, for example, in Japanese Patent Publication Open to Public Inspection Nos. 63-159841, 60-140335, 63-231437, 63-259651, 63-304242, and 63-15245; U.S. Pat. Nos. 4,639,414, 4,740,455, 4,741,966, 4,751,175, and 4,835,096. Useful sensitizing dyes employed in the present invention are described, for example, in publications described in or cited in Research Disclosure Items 17643, Section IV-A (page 23, December 1978), 1831, Section X (page 437, August 1978). Particularly, selected can advantageously be sensitizing dyes having the spectral sensitivity suitable for spectral characteristics of light sources of various types of scanners. For example, dyes are preferably selected from compounds described in Japanese Patent Publication Open to Public Inspection Nos. 9-134078, 9-54409 and 9-80679.

The additives may be incorporated in any layer of photosensitive layer, non-photosensitive layer, or other component layer. In the thermally developable photosensitive material surfactant, anti-oxidant, stabilizer, plasticizer, UV ray absorber, coating aid etc. may be employed. These additives and other additives are disclosed in Research Disclosure 17,029 (June 1978, pages 9–15).

EXAMPLES

In the following, the present invention will be detailed with reference to the examples. However, the present invention is not limited to these examples.

Example 1

<Preparation of Photographic Support>

Polymer resins were obtained as described below.

(PET Resin)

Added to 100 weight parts of dimethyl phthalate and 65 weight parts of ethylene glycol was 0.05 weight part of magnesium acetate hydrate as a transesterification catalyst, and the resulting mixture was subjected to transesterification employing one of several ordinary methods. Added to the resulting products were 0.05 weight part of antimony trioxide and 0.03 weight part of phosphoric acid trimethyl ester. The resulting mixture was gradually heated while reducing the pressure, and underwent polymerization at 280° C. and 0.5 mmHg to obtain polyethylene terephthalate (PET) possessing an intrinsic viscosity of 0.50.

(PEN Resin)

Added to 100 weight parts of dimethyl-2,6-naphthalenedicarboxylic acid and 60 weight parts of ethylene glycol was 0.1 weight part of magnesium acetate hydrate as a transesterification catalyst, and the resulting mixture was subjected to transesterification employing one of several ordinary methods. Added to the resulting products were 0.05 weight part of antimony trioxide and 0.03 weight part of phosphoric acid trimethyl ester. The resulting mixture was gradually heated while reducing the pressure, and underwent polymerization at 290° C. and 0.5 mmHg to obtain polyethylene-2,6-naphthalate (PEN) possessing an intrinsic viscosity of 0.58.

(Copolymerized PET Resin (M-PET))

Added to 100 weight parts of dimethyl phthalate, 56 weight parts of ethylene glycol, and 4.1 weight parts (5 mole percent) of 1,4-butatanediol was 0.1 weight part of magnesium acetate hydrate as a transesterification catalyst, and the resulting mixture was subjected to transesterification employing one of several ordinary methods. Added to the resulting products were 0.04 weight part of antimony trioxide and 0.1 weight part of phosphoric acid trimethyl ester. The resulting mixture was gradually heated while reducing the pressure, and underwent polymerization at 285° C. and 0.5 mmHg to obtain copolymerized polyester (M-PET) comprising polyethylene terephthalate as the main component, possessing an intrinsic viscosity of 0.40.

Employing each polymer prepared as described above, a biaxially stretched polymer film was prepared as described below.

(PET Support Film and M-PET Support Film)

Palletized PET resin or M-PET resin was vacuum dried at 150° C. for 8 hours; was then melt extruded into film from a T die at 285° C.; was brought into close contact with a cooling drum at 30° C. under electrostatic charging and cool solidified to obtain an unstretched film. The resulting unstretched sheet was stretched to a factor of 3.3 times at 80° C. in the longitudinal direction employing a roll system longitudinal stretching device. The resulting uniaxially stretched film was stretched at 90° C. in a first stretching zone employing a tenter system stretching machine so as to obtain a total lateral stretching ratio of 50 percent; further, was stretched at 100° C. in a second stretching zone so as to obtain a total lateral stretching of a factor of 3.3 times. Subsequently, the resulting film was thermally treated at 70° C. for 2 seconds; further, it was thermally fixed at 150° C. for 5 seconds in a first thermally fixing zone; was thermally fixed at 220° C. for 15 seconds in a second thermally fixing zone; subsequently, it was subjected to 5 percent relaxation treatment in the lateral direction, and cooled to room temperature over 60 seconds. The stretched film was released from its clips and was wound. Thus a biaxially stretched film having a thickness of 180 μm was obtained.

(PEN Support Film)

A 180 μm thick biaxially stretched film was obtained in the same manner as preparation of PET support film, except the following: the PET resin was replaced with the PEN resin; the melt extrusion temperature was varied to 300° C.; the cooling drum temperature was varied to 50° C.; the longitudinal stretching temperature was varied to 135° C.; the first lateral stretching zone temperature was varied to 145° C.; the second lateral stretching zone temperature was varied to 155° C.; the pre-heat treatment temperature was varied to 100° C.; the first fixing zone temperature was varied to 200° C.; and second fixing zone temperature was varied to 230° C.

<Preparation of Subbed Photographic Support>

The surface of the 180 μm thick photographic support prepared as above, onto which a thermally developable image forming layer was coated, was subjected to corona discharge at 8 w/m$^2$·minute, and the subbing coating composition a-1 described below was coated onto the resulting film so as to obtained a dry layer thickness of 0.8 μm. The support coated with the subbing coating composition was subjected to thermal treatment at 100° C. for 10 minutes.

<<Subbing Coating Composition>>

| | |
|---|---|
| Polyester based latex b-1 (having a solid portion of 15 percent) | 250 g |
| (C-1) | 0.6 g |
| Water to make | 1 liter |

Polyester Based Latex b-1

| | Latex Composition (Note) | | Tg |
|---|---|---|---|
| | Carboxylic Acid Component | Ethylene Glycol Component | (° C.) |
| b-1 | DMT/DMI/SIPM = 50/40/10 | EG/CHDM = 70/30 | 70 |

Note
DMT: dimethyl phthalate
DMI: dimethyl isophthalate
SIPM: sulfoisophthalate
EG: ethylene glycol
CHDM: cyclohexyldimethanol
(C-1)

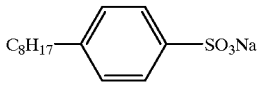

<Coating of Backing Layer>

The backing layer coating composition described below was applied onto the rear surface of the subbed photographic support so as to obtain the coated weight described below. further, drying was carried out at 100° C. for 5 minutes.

| | |
|---|---|
| Cellulose acetate (10% methyl ethyl ketone solution) | 3.75 g/m$^2$ |
| Dye-B | 7 mg/m$^2$ |
| Dye-C | 7 mg/m$^2$ |
| Matting agent (monodispersed silica having a degree of monodispersion | 30 mg/m$^2$ |

-continued

| | |
|---|---|
| of 15 percent and an average particle diameter of 10 μm) | |
| (C-1) | 20 mg/m$^2$ |

Dye-B

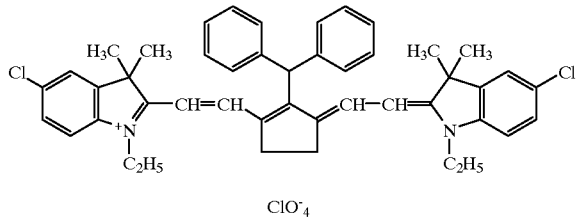

Dye-C

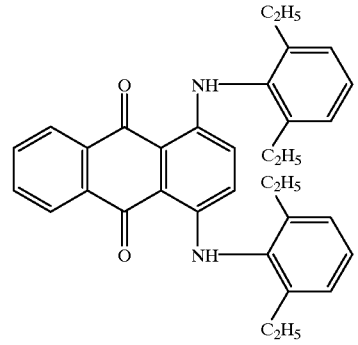

(Preparation of Silver Halide Emulsion A)

Dissolved in 900 ml of water were 7.5 g of inert gelatin and 10 mg of potassium bromide, and the resulting mixture was heated to 35° C. and the pH was adjusted to 3.0. Thereafter, 370 ml of an aqueous solution containing 74 g of silver nitrate, 350 ml of an aqueous solution containing 51 g of potassium bromide and 1.5 g of potassium iodine at a mole ratio of 98/2, and $1\times10^{-6}$ mole of $[Ir(NO)Cl_5]$ and $1\times10^{-4}$ mole of rhodium chloride per mole of silver were added employing a control double jet method while keeping the pAg at 7.7. Thereafter, 4-hydroxy-6-methyl-1,3,3a,7-tetraazaindne was added, and the pH was adjusted to 5 by adding NaOH. Thus cubic silver iodobromide grains were obtained which has an average grain size of 0.06 μm, a variation coefficient of projection diameter area having a degree of monodispersibility of 10 percent of 8 percent, and a [100] plane ratio of 87 percent. The resulting emulsion was flocculated employing a gelatin flocculant and desalted. Thereafter, 0.1 g of phenoxyethanol was added, and the pH and pAg were adjusted to 5.9 and 7.5, respectively to obtain a silver halide emulsion. Further, the resting emulsion underwent chemical sensitization employing chloroauric acid and inorganic sulfur.

(Preparation of Sodium Behenate Solution)

Added to 945 ml of pure water were 32.4 g of behenic acid, 9.9 g of arachidinic acid, and 5.6 g of stearic acid, mixed, and stirred at 90° C. Subsequently, while stirring the resulting mixture at a high speed, 98 ml of a 1.5N aqueous sodium hydroxide solution was added. After adding 0.93 ml of concentrated nitric acid, the resulting mixture was cooled to 55° C. and stirred for 30 minutes to obtain a sodium behenate solution.

(Preparation of Preform Emulsion A Employing Sodium Behenate and Silver Halide A)

Added to the aforementioned sodium behenate solution was 15.1 g of said Silver Halide Emulsion A. After adjusting the pH of the resulting mixture to 8.1, 147 ml of a 1M silver nitrate solution was added over 7 minutes, the resulting mixture was stirred further for 20 minutes, and was subjected to ultrafiltration to remove water-soluble salts. The resulting silver behenate was comprised of grains having an average grain size of 0.8 μm and a degree of monodispersion of 8 percent. After forming a flock of the dispersion, water was removed. After washing and removing water six times, the resulting was dried, which was designated as Preform Emulsion A.

(Preparation of Photosensitive Emulsion A)

Gradually added to the resulting Preform Emulsion A were 544 g of a methyl ethyl ketone solution (15 percent by weight) of polyvinyl butyral (having an average molecular weight of 3,000) and 107 g of toluene, and the resulting mixture was then dispersed at 4,000 psi. The resulting dispersion was designated as Photosensitive Emulsion A. Coating onto the surface of a photosensitive layer Photosensitive layer 1: The liquid having the composition described below was coated so as to obtain an amount of coated silver of 2.1 g/m$^2$.

| | |
|---|---|
| Photosensitive Emulsion A | 240 g |
| Sensitizing Dye-1 (0.1% methanol solution) | 1.7 ml |
| Pyridinium bromide perbromide (6% methanol solution) | 3 ml |
| Calcium bromide (0.1% methanol solution) | 1.7 ml |
| Antifoggant-2 (10% methanol solution) | 1.2 ml |
| 2-(4-chlorobenzoylbenzoic acid (12% methanol solution) | 9.2 ml |
| 2-Mercaptobenzimidazole (1% methanol solution) | 11 ml |
| Tribromomethylsulfoquinoline (5% methanol solution) | 17 ml |
| Developing Agent-1 (20% methanol solution) | 29.5 ml |

Sensitizing Dye-1

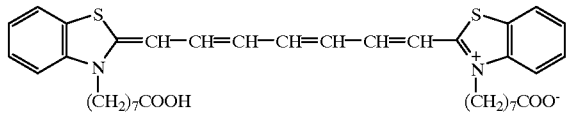

Antifoggant-2

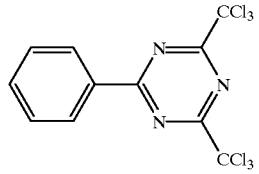

Developing Agent-1 (Reducing agent)

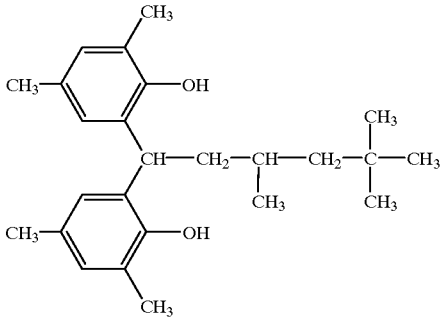

Surface protective layer: a liquid having the composition described below was coated onto the photosensitive layer.

| | |
|---|---|
| Acetone | 35 ml/m$^2$ |
| Methyl ethyl ketone | 17 ml/m$^2$ |
| Cellulose acetate | 2.3 g/m$^2$ |
| Methanol | 7 ml/m$^2$ |
| Phthalazine | 250 mg/m$^2$ |
| 4-Methylphthalic acid | 180 mg/m$^2$ |
| Tetrachlorophthalic acid | 150 mg/m$^2$ |
| Tetrachlorophthalic anhydride | 170 mg/m$^2$ |
| Matting agent (monodispersed silica having a degree of monodispersion of 10 percent and an average grain diameter of 4 μm) | 70 mg/m$^2$ |
| (C-1) | 10 mg/m$^2$ |

Further, before coating an image forming layer, a surface protective layer, and a backing layer, a support, onto which a sublayer had been coated, was humidified at the relative humidity (at 25° C.) shown in Table 1 for 3 hours, and the backing layer was subsequently coated at said relative humidity. Thereafter, the image forming layer, as well as the surface protective layer, was simultaneously coated, and the coating was dried for 5 minutes at a drying temperature of 80° C.

<<Exposure and Development>>

The thermally developable photosensitive material prepared as above was subjected to solid scanning exposure of 5×5 cm employing an imager comprising a semiconductor laser having 810 nm as well 100 mw and an latent image was formed. Thereafter, the exposed material was thermally developed at 110° C. for 15 seconds employing an automatic processor comprising a heat drum so that the surface of the thermally developable image forming layer is brought into contact with said heating drum. The development was carried out in a room conditioned at 23° C. and 50% RH.

<<Evaluation of Image Forming Material>>

(Dimensional Stability of Thermally Developed Image)

After thermal development, the longitudinal and lateral dimensions of a square of the formed image were measured. The ratio of the measured length to that (5 cm) after exposure was denoted as the dimensional stability of the thermally developed image.

A: less than 0.01

B: at least 0.01 to less than 0.02

C: at least 0.02 to less than 0.04

D: at least 0.04 to less than 0.06

D: at least 0.06

(Layer Adhesion)

A sample was brought into contact with a thermal development drum at 120° C. for 25 seconds, and thermally developed. Thereafter, employing a razor blade, 6 longitudinal and 6 lateral scars at an interval of 4 mm were made on the surface, on the side on which the photosensitive layer was coated, and thus 25 squares were formed. Scars were deep enough to reach the surface of the support. A 25 mm wide Mylar tape was adhered on this scarred area and pressed down firmly. The adhered Mylar tape was peeled off, 5 minutes after adhesion, by pulling at a peeling angle of 180°. Then, the number of peeled off squares was measured and graded as follows. Grades A and B are commercially viable.

A: the number of peeled squares was zero

B: the number of peeled squares was below 1

C: the number of peeled squares was below 5

D: at least 5 squares were peeled away (Pre-exposure Storage Stability)

The thermally developable material, as prepared above, was humidified at 23° C. and 55% RH for 4 hours and was then cut into two sheets. One was exposed and thermally developed immediately after humidification. The other was placed in a moisture proofing bag, heated to 55° C. for 3 days, exposed, and thermally developed in the same manners as above. The evaluation (fogging) of the resulting image was carried out employing a densitometer, and the difference between the thermally developed and undeveloped samples was employed as a measure for the pre-exposure storage stability. At the time, fog density was obtained by subtracting the support density from the measured density.

As shown in Table 1, various types of thermally developable materials were prepared as follows; the subbed support was thermally developed or undeveloped, during coating the image forming layer, a backing layer, and the like, the relative humidity was varied, and during humidifying the support, the relative humidity was varied as described in Table 1. Then, evaluation was made for thermal dimensional stability, layer adhesion, and pre-exposure storage stability of the thermally developable material. Table 1 shows the results. Further, the moisture content ratio was measured before measuring the pre-exposure storage stability, and the layer adhesion as well as the dimensional stability was measured before thermal development. Still further, in thermal processing shown in Table 1, gradual cooling means a cooling operation in which a subbed support is thermally processed at 100° C. for 10 minutes, then cooled at the rate so that it is cooled to 70° C. over 5 minutes, and is left standing while cooling to room temperature. Annealing means a thermal processing operation in which a support, after thermal processing, is left standing until reaching room temperature, and then is left standing at 60° C. for 40 hours.

As can clearly be seen in Table 1, when the moisture content ratio of the support of the thermally developable photosensitive materials is adjusted to not more than 0.5 percent, it reveals that the layer adhesion is enhanced, and the heat resistant dimensional stability as well as the pre-exposure storage stability is considered to be excellent.

Example 2

Next, as shown in Table 2, the methanol ratio in a photosensitive layer was varied by replacing methanol, employed to dissolve compounds added to the photosensitive layer, with methanol/MEK in which the methanol was mixed with MEK under an optional ratio. Further, in some conditions, before coating the photosensitive layer, the coating composition was brought into contact with a desiccant (silica gel) for one hour. Thermally developable photosensitive materials were prepared employing other conditions which were the same as those of Thermally Developable Photosensitive Material 1-1 of Example 1 of the present invention, and were evaluated. Table 2 shows the evaluation results. Further, the pre-exposure stability was evaluated by employing a storage temperature of 65° C. over 3 days.

TABLE 2

(Example 2)

| | MEOH Ratio in Coating Composition (in weight %) | Contact with Desiccant | Moisture content Ratio in Coating Composition | Pre-exposure Storage Stability | Layer adhesion | Thermal Dimensional Stability |
|---|---|---|---|---|---|---|
| Present Invention 2-1 | 0.8 | no contact | 1.62 | 0.03 | A | A |
| Present Invention 2-2 | 1.2 | no contact | 1.86 | 0.04 | A | A |
| Present Invention | 0.5 | contact | 1.08 | 0.02 | A | A |

TABLE 1

| Thermally Developable Material Sample No. | Support: Type | Support: Thermal Processing | Support: Relative Humidity (at 25° C.) during Humidification of Support and Coating of Coating Composition | Moisture Content Ratio Support (in %) | Layer Adhesion | Thermal Dimensional Stability | Pre-exposure Storage Stability |
|---|---|---|---|---|---|---|---|
| 1-1' (Comparative Example) | PET | not done | 80% | 0.58 | D | E | 0.08 |
| 1-2' (Comparative Example) | PEN | not done | 80% | 0.65 | E | D | 0.09 |
| 1-3' (Comparative Example) | M-PET | not done | 20% | 1.89 | E | E | 0.13 |
| 1-1 (Present Invention) | PET | not done | 20% | 0.33 | A | B | 0.02 |
| 1-2 (Present Invention) | PEN | not done | 20% | 0.4 | B | A | 0.03 |
| 1-3 (Present Invention) | PET | Done, gradual cooling | 20% | 0.25 | A | A | 0.02 |
| 1-4 (Present Invention) | PET | Done, annealing | 20% | 0.22 | A | A | 0.01 |
| 1-5 (Present Invention) | PET | not done, discharge treatment | 20% | 0.33 | A | A | 0.02 |
| 1-6 (Present Invention) | PET | done | 80% | 0.48 | B | A | 0.03 |

TABLE 2-continued (Example 2)

| | MEOH Ratio in Coating Composition (in weight %) | Contact with Desiccant | Moisture content Ratio in Coating Composition | Pre-exposure Storage Stability | Layer adhesion | Thermal Dimensional Stability |
|---|---|---|---|---|---|---|
| 2-3 Present Invention 2-4 | 0.3 | contact | 0.45 | 0.01 | A | A |

Coating Composition: photosensitive layer
Coating Composition: photosensitive layer As can clearly be seen in Table 2, when the moisture content ratio of the coating composition of the photosensitive layer of the thermally developable photosensitive material is adjusted to not more than 2.0 percent, the layer adhesion is enhanced, and the heat resistant dimensional stability as well as the pre-exposure storage stability is considered to be excellent.

Example 3

Next, after coating the photosensitive layer, the coating was again dried under conditions shown in Table 3. Further, thermally developable photosensitive materials were prepared in the same conditions as those of Thermally Developable Photosensitive Material 1-1 of the present invention of Example 1, except that the ratio of methyl ethyl ketone to toluene was varied, and were evaluated. Table 3 shows the evaluation results.

TABLE 3

(Example 3)

| | Drying Time (in minutes) | MEK/TOL | Moisture Content Ratio of Thermally Developable Photo-sensitive Material | Residual Ratio of Thermally Developable Photo-sensitive Material | Pre-exposure Storage Stability | Layer Adhesion | Thermal Dimensional Stability |
|---|---|---|---|---|---|---|---|
| Present Invention 3-1 | 4 | 93/107 | 0.48 | 1.67 | 0.03 | A | A |
| Present Invention 3-2 | 4 | 122/78 | 0.47 | 1.45 | 0.04 | A | A |
| Present Invention 3-3 | 8 | 148/52 | 0.39 | 1.21 | 0.02 | A | A |
| Present Invention 3-4 | 12 | 148/52 | 0.33 | 0.9 | 0.01 | A | A |

(1) Drying temperature: 80° C.

As can clearly be seen from Table 3, when the moisture content ratio and the residual ratio of the thermally developable photosensitive material are adjusted to not more than 0.5 percent by weight and not more than 2.0 percent by weight, respectively, upon being left standing at 23° C. and 55% RH for 3 hours, the layer adhesion is improved and the heat resistant dimensional stability as well as the pre-exposure storage stability is excellent.

According to the present invention, it has become possible to provide a thermally developable photosensitive material which results in no layer peeling during thermal development, and further exhibits excellent thermal resistant dimensional stability as well as minimized thermal variation in the dimensions.

What is claimed is:

1. A thermally developable photosensitive material comprising a layer containing an organic silver salt, a photosensitive silver halide and a reducing agent provided on a polymer support by coating, wherein the support has a moisture content during coating which is not more than 0.5 percent by weight and wherein the reducing agent is a compound represented by the formula

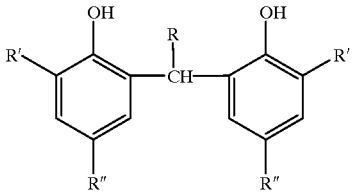

wherein R represents a hydrogen atom or an alkyl group having from 1 to 10 carbon atoms, and R' and R" each represent an alkyl group having from 1 to 5 carbon atoms.

2. The thermally developable photosensitive material of claim 1 wherein the moisture content of the thermally developable photosensitive material after storage for 3 hours at 23° C. and 55% RH is 0.5 percent by weight.

3. The thermally developable photosensitive material of claim 1 wherein the moisture content of the support is 0.01 to 0.5 percent by weight.

4. The thermally developable photosensitive material of claim 1 wherein the layer further contains a binder in an amount of 1.5 to 10 g/m$^2$.

5. The thermally developable photosensitive material of claim 1 wherein the layer comprises a coating composition containing the organic silver salt, the photosensitive silver halide and the reducing agent and has a moisture content of 2 weight % or less.

6. The thermally developable photosensitive material of claim 5 wherein the coating composition is coated on the support whose moisture content is adjusted immediately before the coating to be not more than 0.5 percent by weight.

7. The thermally developable photosensitive material of claim 1 wherein the organic silver salt has an average grain diameter of 1 μm or less.

8. The thermally developable photosensitive material of claim 1 wherein the organic silver salt has an aspect ratio of at least 3.

9. The thermally developable photosensitive material of claim 1 wherein total amount of silver halide and organic silver salt is 0.5 to 2.2 g per $m^2$ in terms of silver amount.

10. The thermally developable photosensitive material of claim 1 wherein the reducing agent is in an amount of $1\times10^{-2}$ to 10 moles per mole of silver.

11. The thermally developable photosensitive material of claim 1 wherein the organic silver is silver behenate or silver arachidinate.

12. The thermally developable photosensitive material of claim 1 which further comprises an organic solvent in an amount of 2.0 percent or less by weight.

13. The thermally developable photosensitive material of claim 1 wherein the support is subjected to a discharge treatment.

14. The thermally developable photosensitive material of claim 1 wherein the organic silver salt has an average grain diameter of 1 μm or less, the reducing agent is in an amount of $1\times10^{-2}$ to 10 moles per mole of silver, and which further comprises a binder in an amount of 1.5 to 10 g/$m^2$, and wherein the silver halide and the organic silver salt total are in a total amount which is 0.5 to 2.2 g per $m^2$ in terms of silver amount.

15. The thermally developable photosensitive material of claim 1 wherein the silver halide is in an amount to the whole silver amount of not more than 50 wt %.

16. The thermally developable photosensitive material of claim 1 wherein the layer has a moisture content of not more than 2.0 percent by weight.

17. The thermally developable photosensitive material of claim 16 wherein the polymer is selected from the group consisting of polyethylene terephthalate, polyethylene naphthalate, polycarbonate, polyethersulfone, polyarylate, polyether ether ketone, polysulfone, polyimide, polyetherimide, polyamide, polystyrene and syndiotactic polystyrene.

18. The thermally developable photosensitive material of claim 17 wherein the support has a thickness of 50 to 250 μm.

19. The thermally developable photosensitive material of claim 18 wherein the organic silver salt has an average grain diameter of 0.02 to 0.08 μm.

20. The thermally developable photosensitive material of claim 19 wherein the reducing agent is a compound selected from the group consisting of

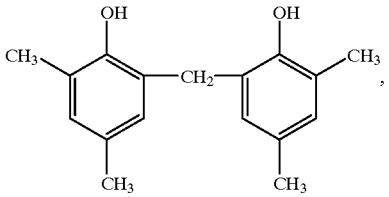

-continued

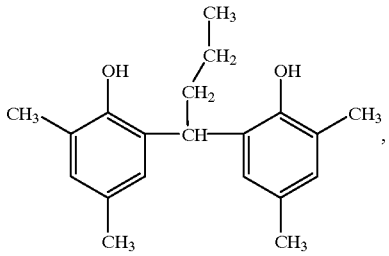

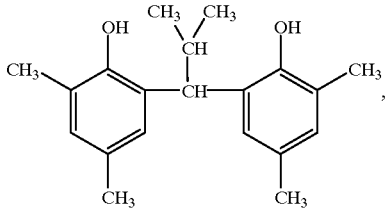

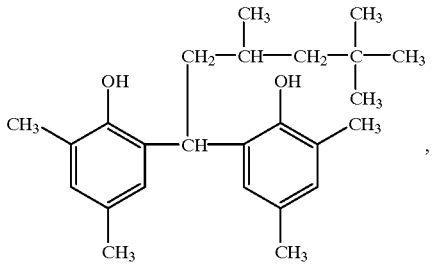

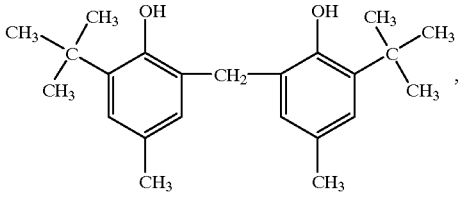

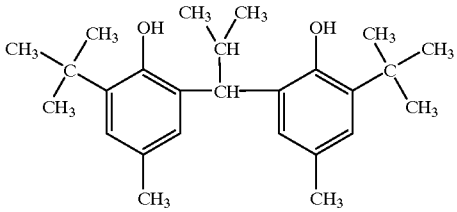

and

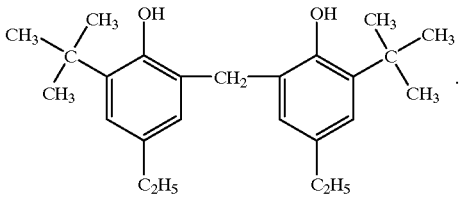

* * * * *